United States Patent [19]

Girard

[11] Patent Number: 4,757,556

[45] Date of Patent: Jul. 19, 1988

[54] GLOVES FOR SKIERS, MOTORCYCLISTS, AND OTHERS

[76] Inventor: Donald A. Girard, P.O. Box 338, Rancho Cordova, Calif. 95670

[21] Appl. No.: 59,793

[22] Filed: Jun. 9, 1987

[51] Int. Cl.[4] ..... A41D 19/00

[52] U.S. Cl. ..... 2/160; 15/227

[58] Field of Search ..... 2/160, 158, 161 R; 15/236 R, 227

[56] References Cited

U.S. PATENT DOCUMENTS

| | | | |
|---|---|---|---|
| 1,402,346 | 1/1922 | Fogg . | |
| 2,745,128 | 5/1956 | Zeuner | 15/227 |
| 3,116,502 | 1/1964 | Gerber | 15/105 |
| 3,735,442 | 5/1973 | Lukas | 15/227 |
| 4,244,057 | 1/1981 | Burnham | 2/160 |
| 4,342,128 | 8/1982 | Doyle | 15/245 |
| 4,538,320 | 9/1985 | Batt | 15/236 |
| 4,683,592 | 8/1987 | Strongwater | 2/160 X |

*Primary Examiner*—Louis K. Rimrodt
*Assistant Examiner*—Judith L. Olds
*Attorney, Agent, or Firm*—Owen, Wickersham & Erickson

[57] ABSTRACT

A glove for a skier or motorcyclists or other person wearing goggles or glasses. The glove has a front glove portion for covering the palm and adjacent forward portions of the fingers, and an enclosing portion connecting the opposite sides of the front portion and enclosing the rest of the hand and fingers. A short, flexible, though somewhat stiff, squeegee is secured to said enclosing portion and extends outwardly therefrom, so that the user can employ the squeegee to free his goggles or glasses from snow or rain deposited thereon.

3 Claims, 2 Drawing Sheets

FIG. 1
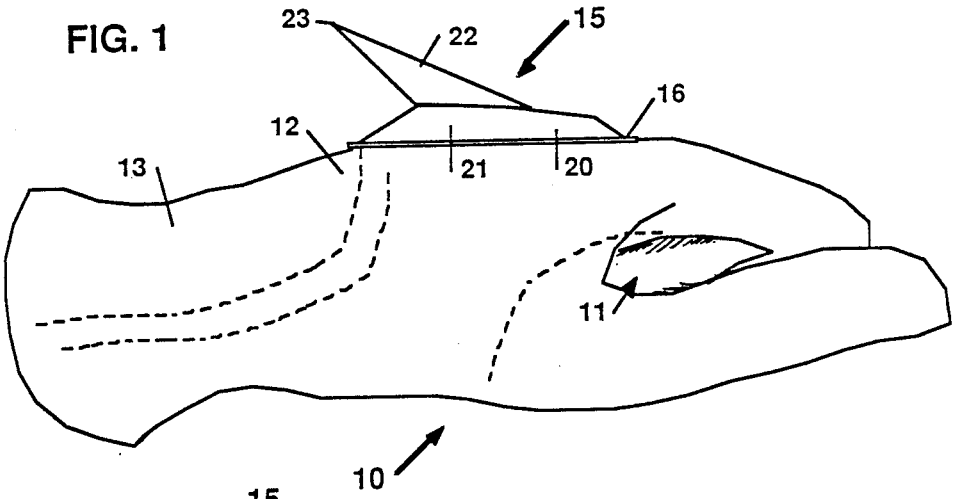
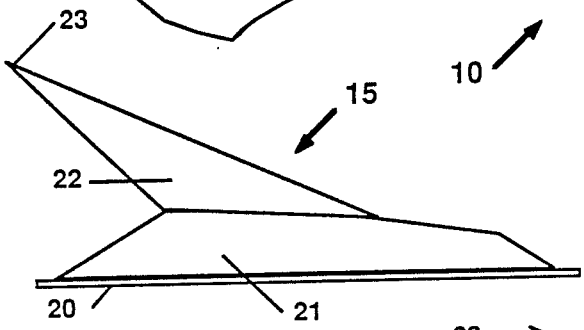
FIG. 2
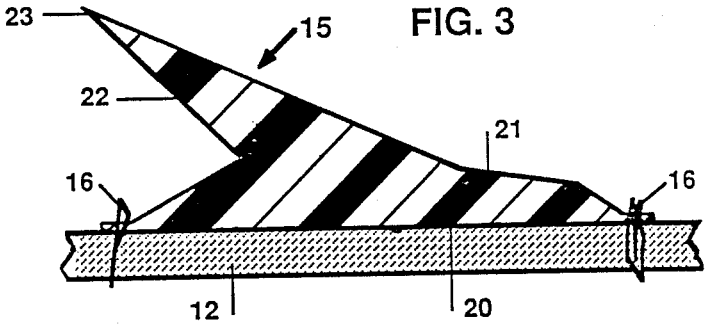
FIG. 3
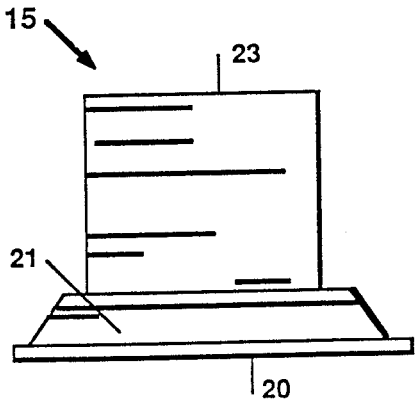
FIG. 4
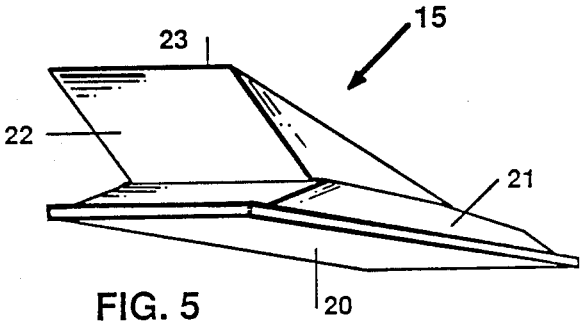
FIG. 5

GLOVES FOR SKIERS, MOTORCYCLISTS, AND OTHERS

This invention relates to a glove for use by skiers and others who wear goggles or glasses in inclement weather.

BACKGROUND OF THE INVENTION

Skiers usually wear goggles to protect their face and eyes from the cold air or snow, or even sometimes rain. In warm weather when the falling snow is wet, or after a fall by the skier into the snow, the ski goggles tend to become covered with snow and make it difficult or impossible for the skier to see. Wiping the goggles with an ordinary skier's glove, merely smears the snow around, and leaves the surface of the goggle wet and difficult to see through. When a skier must remove a tissue or a small chamois from his pocket, it usually entails first removing the gloves, and this is a nuisance, especially when standing on a steep slope in the cold, or when lying down in the snow after a fall. Moreover, neither such a chamois or tissue does a good enough job.

In order to get rid of the snow and clean the goggles, a small squeegee is especially useful, but when it must be carried in the pocket, it presents the same problem of trying to unzip the pocket and remove it with one's gloves on or having to remove one glove first before reaching into the pocket.

Similar problems tend to confront motorcyclists, when rain or snow tends to coat their goggles or glasses and obscure their vision. Others, too, have similar problems.

SUMMARY OF THE INVENTION

In the present invention, at least one glove has a squeegee permanently attached to it, preferably at the back or near the back. This squeegee may be made of rubber or synthetic rubber or other elastomer from which squeegees are usually made. That means that the skier (or other user) can merely wipe the squeegee portion across his goggles or glasses whenever he needs to. With this structure, the goggles can be freed from the snow, even while the skier is in motion.

Other objects, features, and advantages of the invention will appear from the following description of a preferred embodiment of the invention.

BRIEF DESCRIPTION OF THE DRAWINGS

FIG. 1 is a view in side elevation of a glove embodying the principles of the invention.

FIG. 2 is a view in elevation, looking along the line 2—2 in FIG. 6 of the squeegee portion of the glove.

FIG. 3 is a view in section taken along the line 3—3 in FIG. 6.

FIG. 4 is a view in front elevation looking along the line 4—4 in FIG. 6.

FIG. 5 is a view in perspective of the squeegee portion.

DESCRIPTION OF A PREFERRED EMBODIMENT OF THE INVENTION

Figure 6:
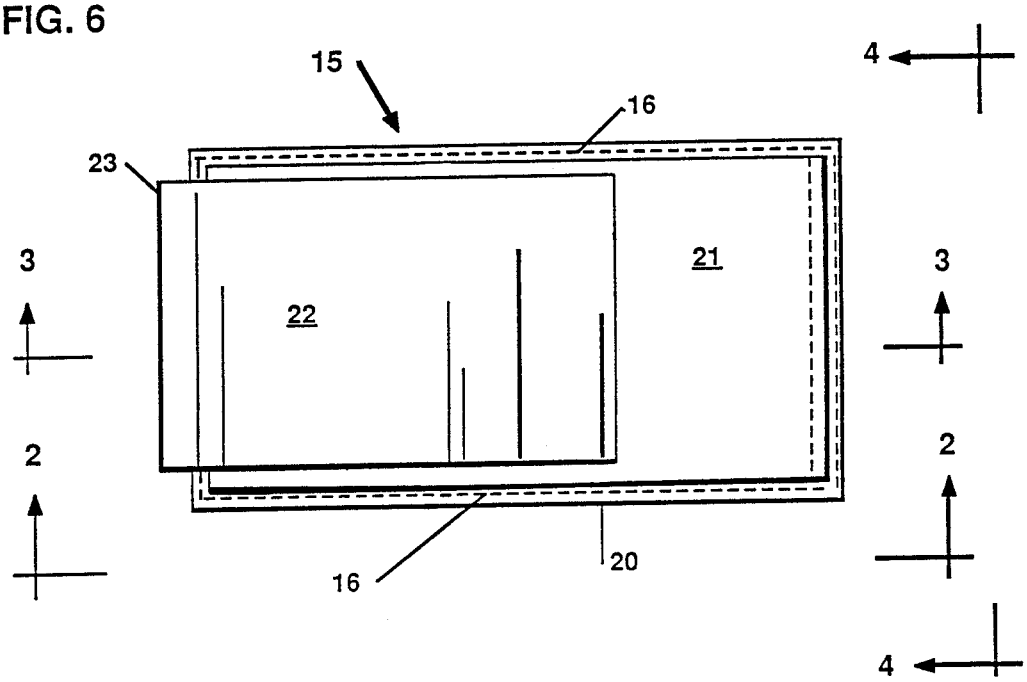
FIG. 6 is a top plan view of the squeegee portion.

As shown in the drawings, the skier's glove 10 may be of a typical type, with a front portion 11 covering the palms and the adjacent and cooperating portions of the fingers, and with an enclosing portion 12 covering the back and the remainder of the hand. There may be a tight portion 13 hugging the wrist or arm near the wrist, and a zipper (not shown) for enabling one to open the glove 10 further for taking it off or putting it on.

On the enclosing portion 12 of the glove 10, preferably at the back, but possibly somewhere near one side, is attached a squeegee 15. The attachment may be done by sewing a series of stitches 16, or by stapling, gluing, bonding or by other means. The squeegee 15 typically has a base portion 20 directly attached to the glove 10 and ensuring that the squeegee 15 will remain where desired. Over the base 20 is a thicker reinforcing portion 21 and a squeegee leaf or fin 22 extends outwardly from the portion 21 and toward the rear of the glove 10. The squeegee fin 22 may extend out at an angle of about 40°. The fin 22 may be tapered to its rather stiff but thin edge 23. The same type of squeegee may be used elsewhere on the glove or, indeed, on a similar mitten.

Figure 7:
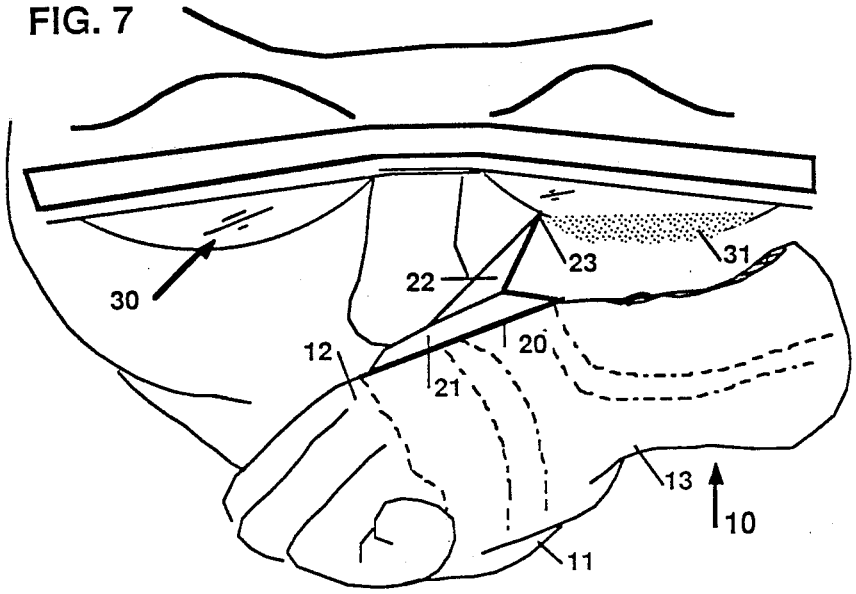
FIG. 7 is a view in elevation of the glove being used to wipe snow off a pair of goggles.

If the skier should fall under the snow, or if the skier should be in falling snow which is itself wet, he may then simply raise the hand having the squeegee glove 10 up near his goggles 30 (FIG. 7) and use the squeegee to wipe the goggles or glasses free from the snow 31. By applying a little pressure, he can get substantially complete removal of the snow 31, so that it does not smear and obscure the visibility through the goggles 30 or glasses. The glove 10 and its squeegee 15 do not interfere with use of the ski poles or of anything else, and yet the squeegee 15 is always available for the simple wiping action, rather than having to be located and removed from a pocket.

Similarly a motorcyclist riding in the rain or snow can clear his goggles or glasses, as can others subjected to basically the same type of problems.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A glove or mitten for a person wearing goggles or glasses in environments where the goggles or glasses tend to come into contact with rain or snow, comprising:

a front portion for covering the person's palm and adjacent forward portions of the fingers, and an enclosing portion for the rear of the hand connecting the opposite sides of the front palm-covering portion and enclosing the rest of the hand and fingers, and a short, flexible, though somewhat stiff, squeegee secured to said enclosing portion immediately next to the back of the hand and extending outwardly a short distance therefrom so that the person can manipulate the squeegee portion with the back of his hand to free his goggles or glasses from snow or rain deposited thereon.

2. A glove or mitten for a person wearing the goggles or glasses in environments where the goggles or glasses tend to come into contact with rain or snow, said glove or mitten having a hand opening at one end comprising:

a front portion for covering the person's palm and adjacent forward portions of the fingers, and an enclosing portion connecting the opposite sides of the front portion and enclosing the rest of the hand and five fingers, and a short, flexible though somewhat stiff, squeegee secured to said enclosing portion and extending outwardly therefrom so that the person can use the squeegee portion to free his goggles or glasses from snow or rain deposited thereon, wherein the squeegee extends out toward the hand opening.

3. The glove of claim 2 wherein the squeegee tapered from a thick portion at the glove to a thin outer edge.

* * * * *